US006942537B2

(12) United States Patent
Bianco et al.

(10) Patent No.: US 6,942,537 B2
(45) Date of Patent: Sep. 13, 2005

(54) BUBBLE BOTTLE AND BUBBLE WAND

(75) Inventors: Michael Bianco, Malibu, CA (US); Brent Oeschger, Malibu, CA (US)

(73) Assignee: Jakks Pacific, Inc., Malibu, CA (US)

( * ) Notice: Subject to any disclaimer, the term of this patent is extended or adjusted under 35 U.S.C. 154(b) by 0 days.

(21) Appl. No.: 10/351,775

(22) Filed: Jan. 27, 2003

(65) Prior Publication Data

US 2004/0198133 A1 Oct. 7, 2004

(51) Int. Cl.[7] ..... A63H 33/28
(52) U.S. Cl. ..... 446/15; 401/122
(58) Field of Search ..... 446/15–21; 220/278, 220/373, 709; 401/122, 446

(56) References Cited

U.S. PATENT DOCUMENTS

D121,802 S * 8/1940 Benjamin, Jr. ..... D9/551
2,858,639 A * 11/1958 Lawrence ..... 446/16
3,579,898 A * 5/1971 Hein ..... 446/16
5,181,875 A * 1/1993 Hasegawa ..... 446/15
5,304,085 A * 4/1994 Novak ..... 446/15
5,653,620 A * 8/1997 Lin ..... 446/15
6,135,842 A * 10/2000 LaFata ..... 446/15

* cited by examiner

*Primary Examiner*—Kien Nguyen
(74) *Attorney, Agent, or Firm*—Richard B. Klar; Law Office of Richard B. Klar

(57) ABSTRACT

A bubble bottle and bubble wand in which a bubble bottle adapted to house bubble fluid therein and having a neck at one end. The neck has a top surface. The top surface has a top closure thereon. The top closure has an aperture therein. A bubble wand is adapted to be removably inserted through the aperture of said bottle to retrieve and bubble fluid contained in said bottle. The closure cap for the bottle is attached to an end of the wand so that when the wand is fully inserted into the bubble bottle the bottle is sealed.

10 Claims, 2 Drawing Sheets

BUBBLE BOTTLE AND BUBBLE WAND

BACKGROUND OF THE INVENTION

1. Field of the Invention

The present invention relates to a bubble bottle and a bubble wand. In particular the invention relates to a bubble bottle and bubble wand in which the wand can be removably inserted through an aperture or slit in a top covered portion of the bottleneck of the bubble bottle.

2. The Related Prior Art

Bubble bottles and bubble wands are known in the prior art. There are various configurations that have been designed. It would however be desirable to produce a simple and effective bubble bottle and bubble wand that would permit one to retrieve bubble fluid without the neck of the bottle being fully opened.

SUMMARY OF THE INVENTION

It is therefore an object of the invention to provide a bubble bottle and bubble wand in which a bubble bottle adapted to house bubble fluid therein and having a neck at one end, said neck having a top surface, said top surface having a top closure thereon, said top closure having an aperture therein and a bubble wand adapted to be removably inserted through said aperture of said bottle to retrieve and bubble fluid contained in said bottle.

It is another object of the invention to provide for a bubble bottle and bubble wand in which in addition the closure cap for the bottle would be attached to an end of the wand so that when the wand is inserted in the bottle the bottle can be closed.

Other objects will become apparent from the foregoing description and drawings.

DETAILED DESCRIPTION OF THE PREFERRED EMBODIMENT

Figure 1:
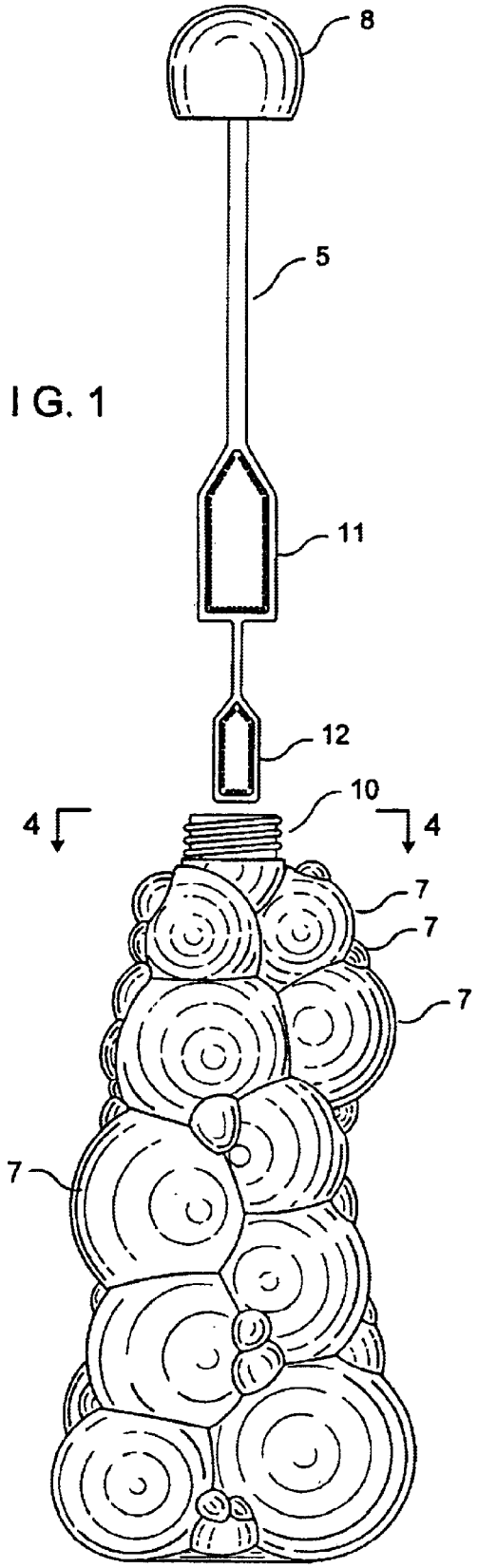
FIG. 1 is a partially exploded front view if the present invention.
Figure 2:
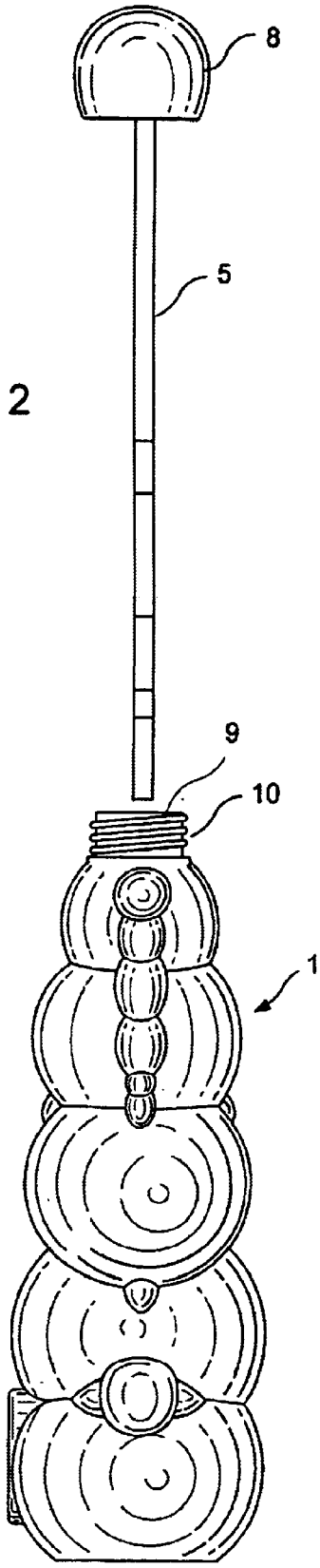
FIG. 2 is a partially exploded side view of the present invention.
Figure 3:
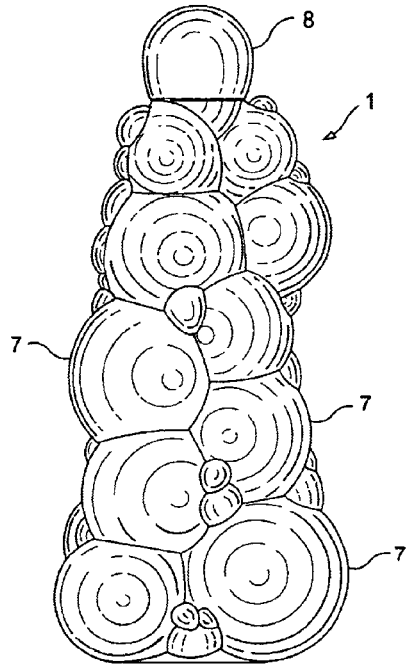
FIG. 3 is a perspective view of the present invention with the wand fully inserted in the bubble bottle in its closed position.

Referring now to FIGS. 1–6, FIGS. 1 and 2 illustrate, from front and side exploded views, respectively, the bubble bottle 1 and bubble wand 5 of the present invention. The bottle 1 is preferably contoured with bubble shapes 7 contoured around the surface of bottle 1 as can be seen in FIGS. 1, 2 and 3.

The bubble wand 5 is shaped as a longitudinally extending wand 5 having a first end that has a cap 8 attached thereto. This cap 8 serves to seal the bottleneck 10 of the bubble bottle 1 when the wand 5 is fully inserted into the bubble bottle 1. The cap 8 has threads (not shown) that engage the threads 9 of the bottleneck 10 for twistingly closing the bubble bottle 1 with the cap 8.

Figure 5:
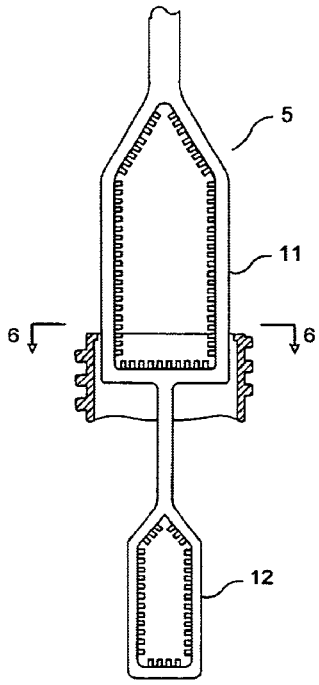
FIG. 5 is a sectional view taken along lines 5—5 of FIG. 4
Figure 4:
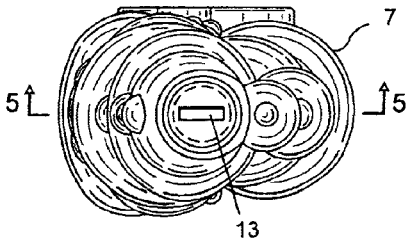
FIG. 4 is a sectional view of the present invention taken along lines 4—4 of FIG. 1.
Figure 6:
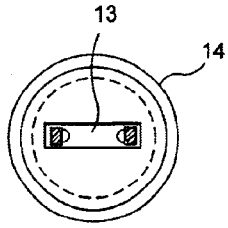
FIG. 6 is a view of the top lid covering the bottleneck of the bubble bottle having an aperture or slit for insertion of the bubble wand into the bubble bottle in accordance with the present invention.

The bubble wand 5 has at least one and preferably two membrane bubble coils 11, 12 to receive bubble fluid housed in the bubble bottle 1 upon insertion of the wand 5 into the bottle 1. The two coils 11, 12 are placed one beneath the other with the smaller coil 12 at the bottom. Each of the coils 11, 12 preferably has a five sided shape. The wand 1 is flat shaped to comfortably pass through an aperture 13 or slit 13 of a top surface or cover 14 that is located and covers (and can be affixed to or otherwise connected to the top surface of the bottleneck 10) above the bottle neck 10 as shown in FIGS. 4, 5 and 6. The larger coil is wider than the remainder of the wand but narrower than the length of the slit 13.

I do not limit myself to any particular details of construction set forth in the specification and illustrated in the accompanying drawings, as the same refers to and sets forth only certain embodiments of the invention, and it is observed that the same may be modified without departing from the spirit and scope of the claimed invention.

What is claimed is:

1. A bubble bottle for use with a bubble wand, comprising:

a bubble bottle adapted to house bubble fluid therein and having a neck at one end, said neck having a top surface, said top surface having a top closure thereon, said top closure having an aperture therein, said aperture being formed as a slit and said slit having a length, said bubble bottle having a surface area that is substantially covered by a plurality of bubble shaped contours;

a bubble wand adapted to be fully removable and to be removably inserted through said slit of said bottle to retrieve said bubble fluid contained in said bottle, wherein said bubble wand has a cap at one end of said bubble wand adapted to secure said neck of said bottle to close said top of said bubble bottle, said wand has at least one bubble membrane coil for collecting bubble fluid from said bottle, said at least one bubble membrane having a width wider than a width of a remainder of said wand and narrower than said length of said slit so that said wand comfortably passes through said slit.

2. The bubble bottle according to claim 1 wherein said wand has two bubble membrane coils adapted to collect bubble fluid from said bottle, each of said bubble membranes having a width that is wider than a remainder of a width of said wand.

3. The bubble bottle according to claim 1 wherein said wand is substantially flat on two sides so as to slide into said aperture of said bottle and has a substantially five sided shape.

4. The bubble bottle according to claim 1 wherein said bubble wand has two membrane coils vertically aligned so that a first one of said membrane coils is disposed vertically underneath a remaining one of said membrane coils, each of said bubble membranes having a width that is wider than a remainder of a width of said wand and narrower than said length of said slit.

5. The bubble bottle of claim 1 wherein said cap threadably engages said bottle neck of said bubble bottle.

6. In combination, a bubble bottle and bubble wand, comprising:

a bubble bottle adapted to house bubble fluid therein and having a neck at one end, said neck having a top surface, said top surface having a top closure thereon, said top closure having an aperture therein wherein said aperture is formed as a slit and said slit having a length, said bubble bottle having a surface area that is substantially covered by a plurality of bubble shaped contours;

a bubble wand adapted to be fully removable and to be removably inserted through said slit of said bottle to retrieve and bubble fluid contained in said bottle, wherein said bubble wand has a cap at one end of said bubble wand adapted to secure said neck of said bottle to close said top of said bubble bottle, said at least one bubble membrane having a width wider than a width of a remainder of said wand and narrower than said length of said slit so that said wand comfortably passes through said slit.

7. The combination according to claim 6 wherein said wand has two bubble membrane coils adapted to collect bubble fluid from said bottle, each of said bubble membranes having a width that is wider than a remainder of a width of said wand and narrower than said length of slit.

8. The combination according to claim 6 wherein said wand is substantially flat on two sides so as to slide into said aperture of said bottle and has a substantially five sided shape.

9. The combination according to claim 6 wherein said bubble wand has two membrane coils vertically aligned so that a first one of said membrane coils is disposed vertically underneath a remaining one of said membrane coils, each of said bubble membranes having a width that is wider than a remainder of a width of said wand.

10. The bubble bottle of claim 6 wherein said cap threadably engages said bottle neck of said bubble bottle.

* * * * *